US006962215B2

(12) United States Patent
Curtis et al.

(10) Patent No.: US 6,962,215 B2
(45) Date of Patent: Nov. 8, 2005

(54) UNDERBALANCED WELL COMPLETION

(75) Inventors: Fredrick D. Curtis, Stafford, TX (US); Derrick W. Lewis, The Woodlands, TX (US); Dale E. Ray, The Woodlands, TX (US); Michael J. Harvey, Granite Shoals, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/426,917

(22) Filed: Apr. 30, 2003

(65) Prior Publication Data

US 2005/0034854 A1 Feb. 17, 2005

(51) Int. Cl.[7] ..... E21B 10/64

(52) U.S. Cl. ..... 175/257; 175/235; 175/309; 175/318; 166/317; 166/332.4

(58) Field of Search ..... 166/317, 332.4, 166/332.8; 175/234, 235, 257, 309, 318

(56) References Cited

U.S. PATENT DOCUMENTS

| | | | | |
|---|---|---|---|---|
| 4,606,416 | A * | 8/1986 | Knighton et al. | 175/58 |
| 6,142,226 | A | 11/2000 | Vick | |
| 6,152,232 | A | 11/2000 | Webb et al. | |
| 6,167,974 | B1 | 1/2001 | Webb | |
| 6,343,658 | B2 | 2/2002 | Webb | |
| 6,557,637 | B1 * | 5/2003 | Dore et al. | 166/338 |

OTHER PUBLICATIONS

Weatherford Drilling & Intervention Services, Underbalanced Drilling: Undeniable Success, dated Mar., 2002.
Weatherford Products & Services Catalog, title page, p. 24 including "Underbalanced Downhole Tools," and back page, dated 2002.
A Series of Three Drill Bit Illustrations Showing a Drill Bit Being Conveyed Through a Valve Interconnected in a Tubular String in a Well—on Sale More Than One Year Prior to the Filing of the Present Applicaton (undated).
Halliburtion Brochure entitled, "Quick-Trip Valve Making Underbalanced Operations Easier and Safer," dated Apr., 2002.

* cited by examiner

*Primary Examiner*—Zakiya Walker
(74) *Attorney, Agent, or Firm*—Marlin R. Smith

(57) ABSTRACT

Equipment and methods which may be used in conjunction with an underbalanced well completion. In a described embodiment, a valve for use in a subterranean well in conjunction with a tool conveyed through the valve in a container is provided. The valve includes a passage formed longitudinally through the valve, a closure assembly which selectively permits and prevents flow through the passage, and an engagement device which engages the container as the tool is conveyed through the passage. The closure assembly permits flow through the passage when the container is conveyed into the passage, and the closure assembly prevents flow through the passage when the container is removed from the passage. Engagement between the container and the engagement device separates the tool from the container.

40 Claims, 4 Drawing Sheets

UNDERBALANCED WELL COMPLETION

BACKGROUND

The present invention relates generally to operations performed and equipment utilized in conjunction with subterranean wells and, in an embodiment described herein, more particularly provides equipment and methods for use in underbalanced well completions.

At times it is useful to be able to isolate a portion of a tubular string, such as a production tubing, drill pipe, liner or casing string, from the remainder of the tubular string. For example, while drilling underbalanced, it is useful to be able to periodically trip a drill string in and out of the well without killing the well. In that instance, a valve may be interconnected in a casing string, the valve being opened upon tripping in the drill string, and the valve being closed when the drill string is tripped out of the well. A valve suitable for such an application is described in U.S. Pat. No. 6,152,232, the entire disclosure of which is incorporated herein by this reference.

Other uses include running completion assemblies (including perforated or slotted liners) after drilling underbalanced, drilling overbalanced in areas of lost circulation to prevent kicks and loss of mud while tripping the drill string, and drilling in deep water where pore pressure and fracture gradient provide a narrow window for acceptable mud density and use of lower mud density is desired.

From the foregoing, it can be seen that it would be quite desirable to provide improvements in underbalanced well drilling and completions, in other operations, and in equipment utilized in these operations.

SUMMARY

In carrying out the principles of the present invention, in accordance with an embodiment thereof, an apparatus is provided which is an improvement over prior equipment utilized in the operations described above.

In one aspect of the invention, a well system is provided. The well system includes an apparatus positioned in a well and a tool conveyed through the apparatus in a container. The container engages the apparatus, actuating the apparatus and separating from the tool, as the tool is displaced through the apparatus.

In another aspect of the invention, an apparatus for use in a subterranean well in conjunction with a tool conveyed through the apparatus in a container is provided. The apparatus includes an engagement device which engages the container, preventing relative displacement between the container and the apparatus, as the tool is conveyed through the apparatus.

In yet another aspect of the invention, a valve for use in a subterranean well in conjunction with a tool conveyed through the valve in a container is provided. The valve includes a passage formed longitudinally through the valve, a closure assembly which selectively permits and prevents flow through the passage, and an engagement device which engages the container as the tool is conveyed through the passage. The closure assembly permits flow through the passage when the container is conveyed into the passage, and the closure assembly prevents flow through the passage when the container is removed from the passage. Engagement between the container and the engagement device separates the tool from the container.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
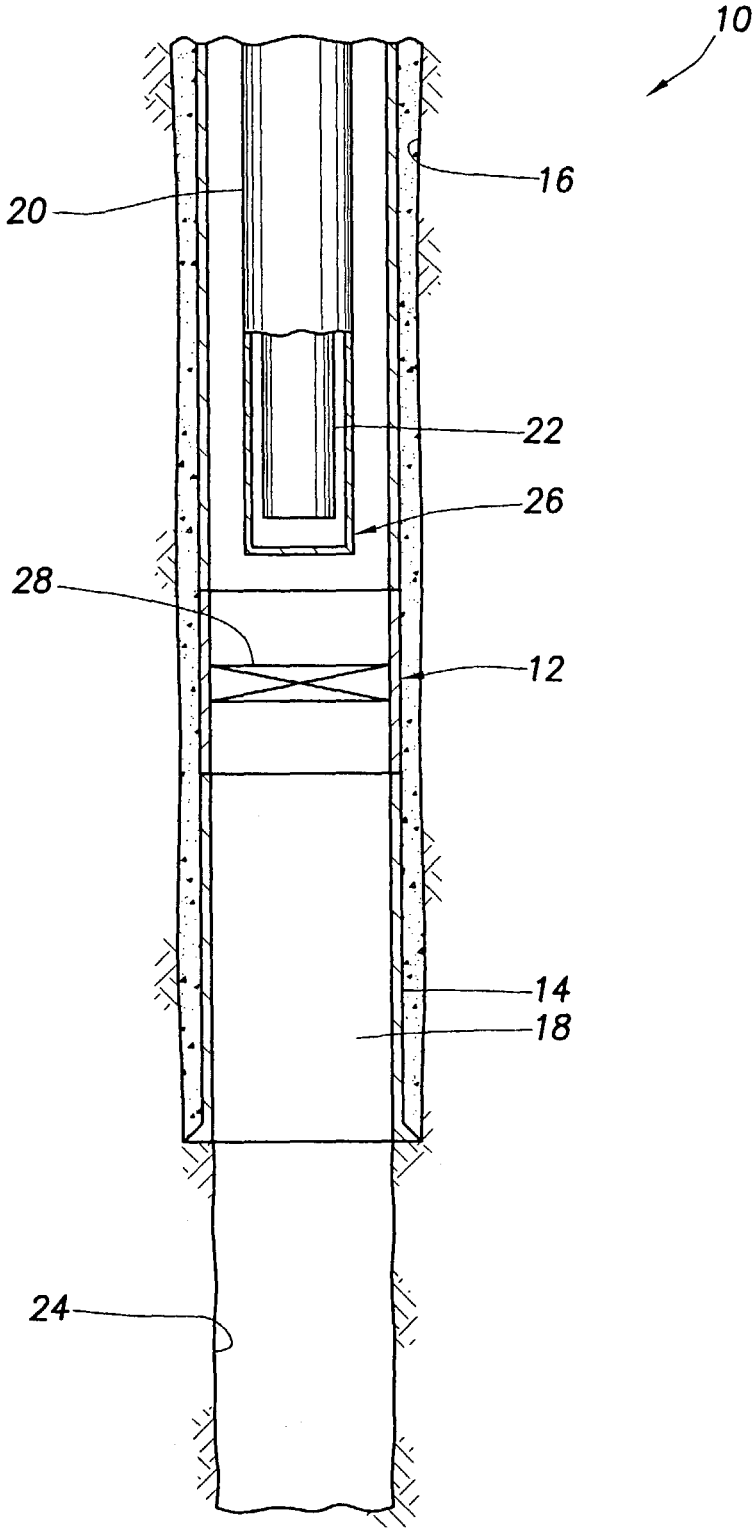
FIG. 1 is a schematic partially cross-sectional view of a well system embodying principles of the present invention.

Representatively illustrated in FIG. 1 is a well system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, the system 10 includes an apparatus 12 interconnected in a tubular string 14 positioned in a wellbore 16. Representatively, the apparatus 12 is a valve which selectively permits and prevents flow through an interior passage 18 of the string 14, and the string is a casing string cemented in the wellbore 16. However, it should be clearly understood that the invention is not limited to these, or any other, specific details of the illustrated system 10. For example, the casing string 14 could instead be a production tubing string, drill string, etc.

Another tubular string 20 is positioned in the casing string 14. The tubular string 20 is used in the system 10 to convey a tool 22 through the passage 18. Representatively, the string 20 is a drill string. However, the string 20 could be another type of conveyance, such as a production tubing string, a wireline, etc., in keeping with the principles of the invention.

The tool 22 could be a drill bit, a perforated or slotted liner, a mud motor, a production tool, a completion tool, a drilling tool, a packer, a multilateral tool, or any other type of well tool. Representatively, the tool 22 is a drill bit used to drill a wellbore extension 24 below the casing string 14. In this situation, it may be desirable to close the valve 12 while the string 20 is tripped in and out of the wellbore 16, such as when drilling overbalanced or underbalanced, but the valve would be opened when the drill bit 22 is conveyed therethrough into the wellbore extension 24 for further drilling.

In a unique feature of the invention, the drill bit 22 is conveyed in a container 26 attached to the drill string 20. As the container 26 is conveyed into the valve 12, the container engages the valve, operates the valve to open a closure assembly 28 of the valve, and then the container disengages from the tool, allowing the tool 22 to be conveyed into the wellbore extension 24 on the drill string 20, without the container.

One advantage of this system lo is that the container 26 may be configured so that it can accommodate a variety of tools, and so a different container does not have to be constructed for each tool conveyed through the valve 12. For example, the container 26 may be used to convey the drill bit 22 through the valve 12 during drilling operations, and then the same or a similar container may be used to convey an item of completion equipment (such as a packer, etc.) through the valve after drilling operations are completed.

Figure 2:
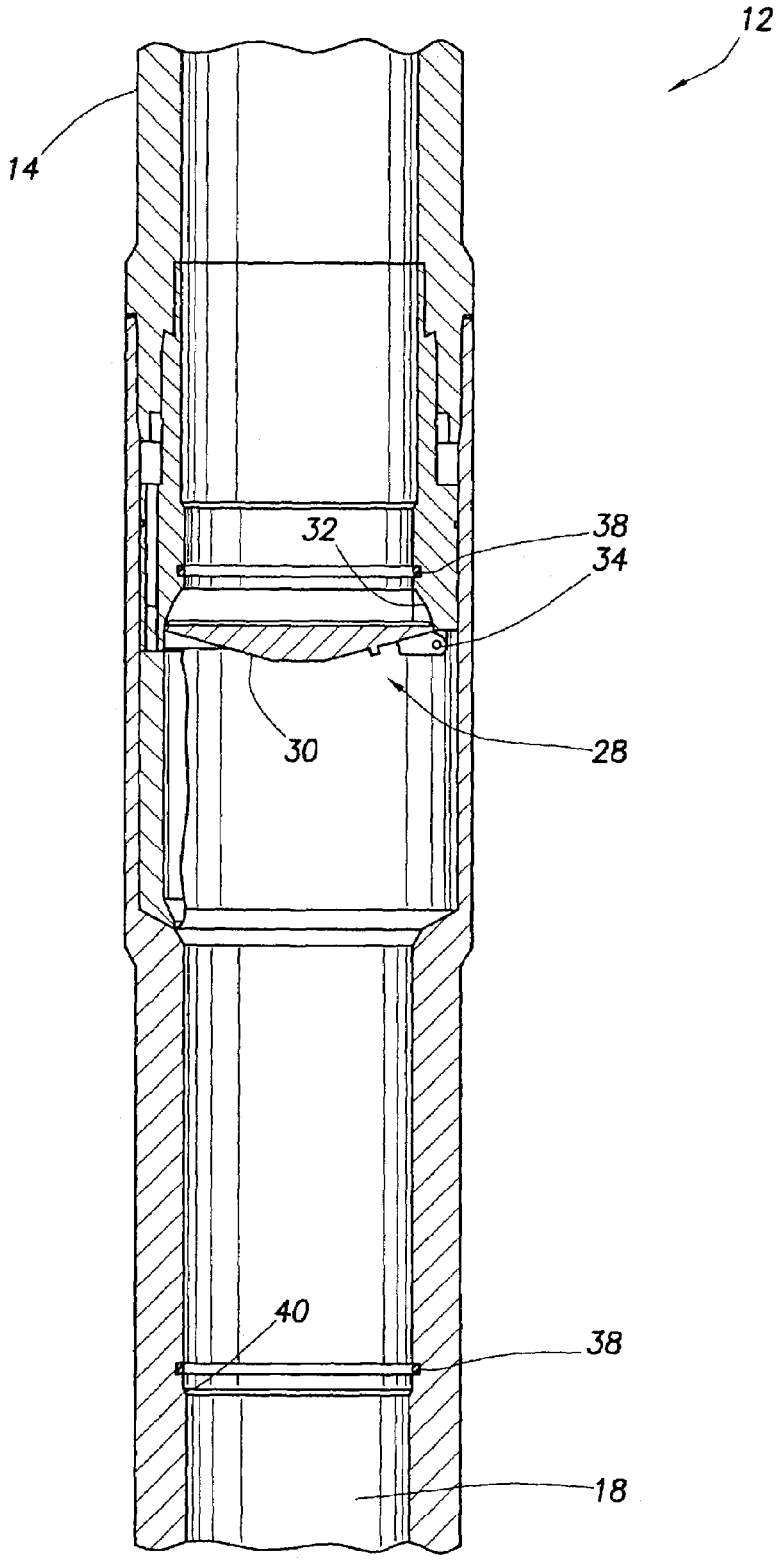
FIG. 2 is a cross-sectional view of an apparatus used in the well system of FIG. 1, the apparatus embodying principles of the invention, and the apparatus being depicted in an initial configuration.

Referring additionally now to FIG. 2, an enlarged cross-sectional view of the valve 12 is representatively illustrated. In this view it may be seen that the closure assembly 28 is depicted as including a flapper 30 pivotably supported relative to a seat 32.

When closed as shown in FIG. 2, the flapper 30 prevents flow through the passage 18. However, when pivoted downward about a pivot 34, the flapper 30 no longer contacts the seat 32, and flow is then permitted through the passage 18. Note that other types of closure assemblies may be used in place of, or in addition to, the assembly 28. For example, the closure assembly 28 could include a ball closure, a sleeve closure, etc.

Figure 3:
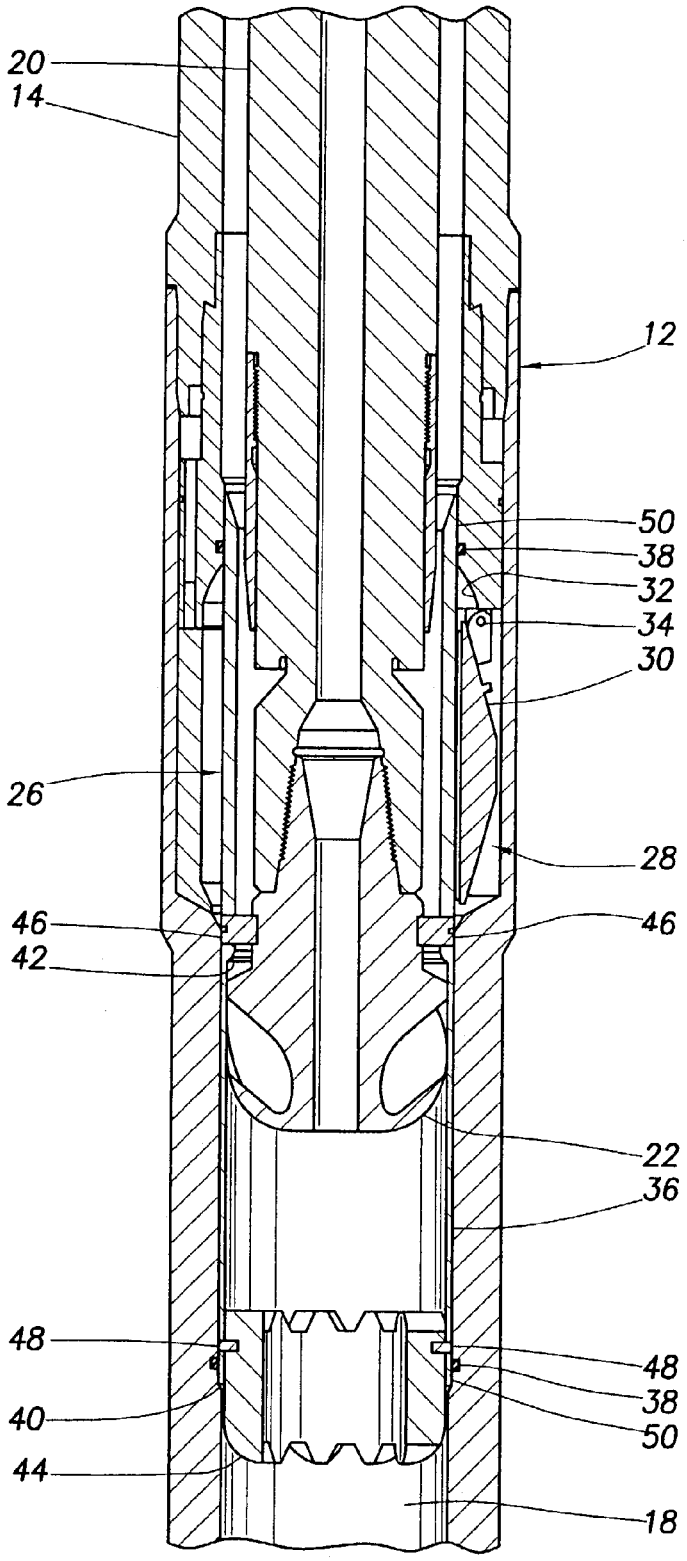
FIG. 3 is a cross-sectional view of the apparatus depicted in a configuration in which an engagement device of the apparatus has engaged a container containing a tool being conveyed through the apparatus.

Referring additionally now to FIG. 3, the valve 12 is depicted with the drill string 20 conveyed through the casing string 14. The drill bit 22 is contained within the container 26, which is shown engaged with the valve 12. This engagement includes sealing engagement between a sleeve 36 of the container 26 and seals 38 axially straddling the closure assembly 28, and contact between the sleeve and an internal shoulder 40 formed in the valve 12 which prevents further downward displacement of the sleeve through the passage 18.

The drill bit 22 is contained in the sleeve 36 between a shoulder 42 formed internally on the sleeve and a plug or abutment 44 closing off a lower end of the sleeve. If desired, the drill bit 22 may additionally be secured relative to the sleeve 36, for example, using shear screws 46 or another type of securing device. However, preferably the drill bit 22 is permitted to rotate and/or reciprocate within the container 26.

The abutment 44 may be secured relative to the sleeve 36 using shear screws 48, or another type of securing device. Preferably, the abutment 44 is made of a tough but relatively easily drillable material, such as a composite material, relatively soft metal, etc. The abutment 44 may be bonded to the sleeve 36, for example, using adhesives or other bonding agents.

The sleeve 36 could also be made of a composite material (or another relatively easily drillable material), in which case the sleeve and abutment 44 could be molded together, or otherwise integrally formed. If the sleeve 36 is made of a composite material, then the seal surfaces 50 may also be made of a composite material, or another relatively easily drillable material.

As the container 26 is conveyed into the valve 12, the abutment 44 contacts the closure assembly 28 and pivots the flapper 30 downward, thereby opening the passage 18. Damage to the flapper 30 and seat 32 is prevented in part by the abutment 44 being made of the relatively easily drillable material.

The sleeve 36 then enters and maintains the flapper 30 in its opened position. Again, damage to the flapper 30 and seat 32 may be prevented by the sleeve 36 being made of the relatively easily drillable material. Sealing engagement between the seals 38 and seal surfaces 50 formed externally on the sleeve 36 isolates the closure assembly 28 from debris, etc. in the passage 18.

For example, during drilling operations this sealing engagement may prevent cuttings from becoming lodged in the closure assembly 28. The sleeve 36, or a similar sleeve, may be positioned in the valve 12 while the casing 14 is cemented in the wellbore 16, in which case the sleeve would prevent cement from contacting the closure assembly 28.

As described above, a lower end of the sleeve 36 contacts the shoulder 40, preventing further downward displacement of the sleeve relative to the valve 12. If the shear screws 46 or other securing devices are used, then at this point a downwardly directed force may be applied to the drill bit 22 (such as by slacking off on the drill string 20 to apply the drill string weight to the bit) in order to shear the screws 46. However, if the drill bit 22 is not secured to the sleeve 36 (other than being contained between the shoulder 42 and abutment 44), then this step is not needed.

Figure 4:
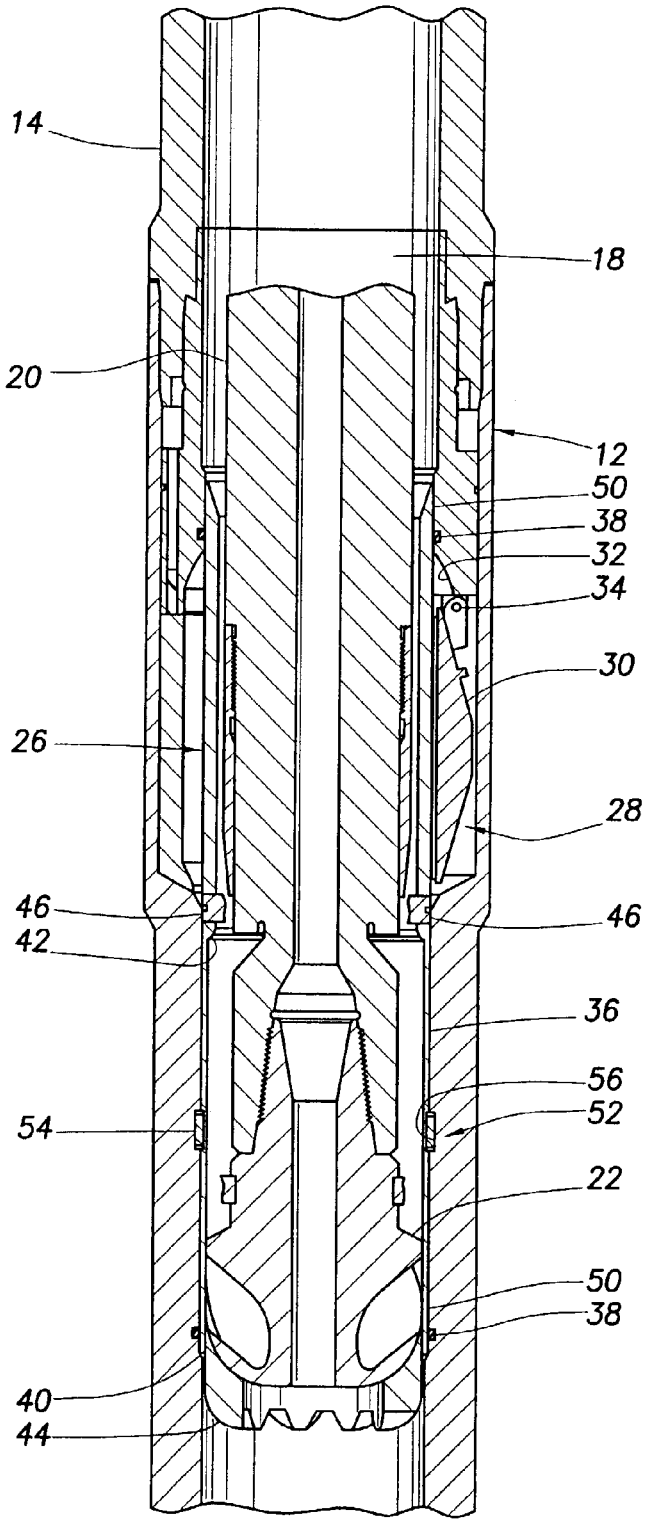
FIG. 4 is a cross-sectional view of the apparatus depicted in a configuration in which the tool is being used to cut through a portion of the container.

Referring additionally now to FIG. 4, the valve 12 is depicted after the shear screws 46 have been sheared and the drill bit 22 has been displaced downward relative to the sleeve 36. The drill bit 22 now contacts the abutment 44.

As illustrated in FIG. 4, the drill bit 22 is being used to cut through the abutment 44 while the abutment remains attached to the sleeve 36. This will release the drill bit 22 from within the container 26, allowing the drill bit and the drill string 20 to displace through the open valve 12. The alternative configuration depicted in FIG. 4 has the abutment 44 bonded to the sleeve 36.

However, if the abutment 44 is releasably attached to the sleeve 36, such as by using the shear screws 48 as depicted in FIG. 3, then the downward displacement of the drill bit 22 into contact with the abutment 44 may operate to shear the screws and release the abutment from the sleeve. In that case, the drill bit 22 may not cut into the abutment 44 until after the abutment falls (or is pushed) to the bottom of the wellbore extension 24.

FIG. 4 also depicts another type of engagement device 52 used to provide engagement between the sleeve 36 and the valve 12. The engagement device 52 includes a snap ring 54 (such as a C-shaped or spiral ring) engaged with a groove 56 formed internally on the valve 12. The snap ring 54 is preferably carried externally on the sleeve 36 and, when the sleeve is properly positioned relative to the valve 12, the snap ring snaps into the groove 56, thereby releasably securing the sleeve relative to the valve. Note that the engagement device 52 may be used as an alternative to, or in addition to, the engagement between the lower end of the sleeve 36 and the shoulder 40.

After the drill bit 22 has cut through or otherwise released the abutment 44 from the sleeve 36, the drill bit and drill string 20 are used to drill the wellbore extension 24. When the time comes to trip the drill string 20 out of the wellbore, or otherwise raise the drill bit 22 back up through the valve 12, the drill bit will eventually contact the internal shoulder 42 in the sleeve 36. As the drill bit 22 is raised further, the sleeve 36 will also be raised therewith, and with the sleeve no longer maintaining the flapper 30 in its open position, the closure assembly 28 will close off the passage 18.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well system, comprising:

an apparatus positioned in a well; and a tool conveyed through the apparatus in a container, the tool and the container being displaced together into the apparatus, the container engaging the apparatus, actuating the apparatus and separating from the tool, as the tool is displaced through the apparatus.

2. The well system according to claim 1, wherein the container permits rotation of the tool within the container.

3. The well system according to claim 1, wherein the container permits reciprocation of the tool within the container.

4. The well system according to claim 1, wherein at least a portion of the container is made of a relatively easily drillable material.

5. The well system according to claim 1, wherein the container includes a sleeve encircling the tool.

6. The well system according to claim 5, wherein the sleeve is made of a relatively easily drillable material.

7. The well system according to claim 1, wherein the container includes an abutment preventing release of the tool from the container.

8. The well system according to claim 7, wherein the abutment is made of a relatively easily drillable material.

9. The well system according to claim 7, wherein the abutment is releasable from the container, thereby releasing the tool from the container, when the tool is displaced through the apparatus.

10. The well system according to claim 1, wherein the container includes a seal surface made of a relatively easily drillable material.

11. An apparatus for use in a subterranean well in conjunction with a tool conveyed through the apparatus in a container, the apparatus comprising:

an engagement device which engages the container as the container and tool are displaced together into the apparatus, preventing relative displacement between the container and the apparatus, as the tool is conveyed through the apparatus.

12. The apparatus according to claim 11, wherein engagement between the engagement device and the container causes the container to separate from the tool.

13. The apparatus according to claim 11, wherein the container includes an abutment preventing release of the tool from the container.

14. The apparatus according to claim 13, wherein the abutment is made of a relatively easily drillable material.

15. The apparatus according to claim 13, wherein the abutment is releasably secured to a sleeve of the container.

16. The apparatus according to claim 15, wherein the sleeve is made of a relatively easily drillable material.

17. The apparatus according to claim 15, wherein the sleeve includes a seal surface made of a relatively easily drillable material.

18. The apparatus according to claim 11, wherein the container further engages a closure assembly of the apparatus.

19. The apparatus according to claim 18, wherein the apparatus is a valve which selectively permits and prevents flow through the passage, the closure assembly opening and closing the valve in response to displacement of the container in the passage.

20. The apparatus according to claim 11, wherein the tool is a drill bit, and wherein the drill bit cuts through a portion of the container after the container engages the engagement device.

21. The apparatus according to claim 20, wherein the portion of the container is made of a composite material.

22. The apparatus according to claim 20, wherein the portion of the container is made of a relatively easily drillable material.

23. A valve for use in a subterranean well in conjunction with a tool conveyed through the apparatus in a container, the valve comprising:

a passage formed longitudinally through the valve;

a closure assembly which selectively permits and prevents flow through the passage, the closure assembly permitting flow through the passage when the container is conveyed into the passage together with the tool, and the closure assembly preventing flow through the passage when the container is removed from the passage together with the tool; and an engagement device which engages the container as the tool is conveyed through the passage, thereby separating the tool from the container.

24. The valve according to claim 23, wherein at least a portion of the container is made of a relatively easily drillable material.

25. The valve according to claim 24, wherein the material is a composite material.

26. The valve according to claim 24, wherein the material is a relatively soft metal.

27. The valve according to claim 24, wherein the container portion is an abutment which prevents release of the tool from the container.

28. The valve according to claim 24, wherein the container portion is a sleeve which encircles the tool.

29. The valve according to claim 24, wherein the container portion is a seal surface.

30. The valve according to claim 23, wherein the tool is a drill bit.

31. The valve according to claim 23, wherein the tool is a liner.

32. The valve according to claim 23, wherein the tool is a mud motor.

33. The valve according to claim 23, wherein the tool is a production tool.

34. The valve according to claim 23, wherein the tool is a completion tool.

35. The valve according to claim 23, wherein the tool is a drilling tool.

36. The valve according to claim 23, wherein the tool is a packer.

37. The valve according to claim 23, wherein the tool is a multilateral tool.

38. The valve according to claim 23, wherein the container includes a sleeve and an abutment, the abutment being releasably attached to the sleeve.

39. The valve according to claim 38, wherein the abutment is released from the sleeve, thereby releasing the tool from the container, when the container engages the engagement device.

40. The valve according to claim 38, wherein the abutment is cut by the tool after the abutment is released from the sleeve.

* * * * *